US005148569A

United States Patent [19]

Jailor et al.

[11] Patent Number: 5,148,569

[45] Date of Patent: Sep. 22, 1992

[54] DEBRIS IMPELLER

[75] Inventors: John J. Jailor, Rockford; Henry J. Rosendall, Grand Rapids, both of Mich.

[73] Assignee: Bissell Inc., Grand Rapids, Mich.

[21] Appl. No.: 599,309

[22] Filed: Oct. 17, 1990

[51] Int. Cl.[5] ..... A47L 11/33; A47L 11/40

[52] U.S. Cl. ..... 15/041.1; 15/91; 15/230.14; 15/230.16; 29/121.1; 29/121.5; 29/124

[58] Field of Search ..... 15/98, 41.1, 43, 50.3, 15/52.1, 55, 82, 230, 230.14, 230.16, 383, 91, 92; 300/21; 29/121.1, 121.4, 121.5, 124; 366/326

[56] References Cited

U.S. PATENT DOCUMENTS

| | | | |
|---|---|---|---|
| 848,974 | 4/1907 | Crossman . | |
| 1,267,304 | 5/1918 | Adams . | |
| 1,370,256 | 3/1921 | Adams . | |
| 1,558,554 | 10/1925 | Holzapfel et al. . | |
| 1,919,067 | 7/1933 | Lang et al. | 15/383 |
| 2,657,620 | 11/1953 | Meeks | 97/40 |
| 2,929,088 | 3/1960 | Wier, Jr. | 15/230.16 |
| 2,994,098 | 8/1961 | Fukuba | 15/342 |
| 3,381,759 | 5/1968 | Buhr | 172/540 |
| 3,431,571 | 3/1969 | Kraus | 15/23 |
| 3,843,989 | 10/1974 | DeMaagd | 15/50 C |
| 4,043,399 | 8/1977 | Morrison | 172/42 |
| 4,200,965 | 5/1980 | Roth | 29/81 J |
| 4,425,248 | 5/1984 | Hait | 15/198 |
| 4,604,766 | 8/1986 | Avery | 15/50 |
| 4,646,380 | 3/1987 | Kobayashi et al. | 15/41 R |
| 4,845,797 | 7/1989 | Kobayashi | 15/41 R |

FOREIGN PATENT DOCUMENTS

| | | | |
|---|---|---|---|
| 642819 | 9/1950 | United Kingdom . | |
| 2186188 | 8/1987 | United Kingdom | 15/230.14 |

OTHER PUBLICATIONS

"Santoprene" Thermoplastic Rubber by Monsanto 1988.

*Primary Examiner*—Edward L. Roberts
*Attorney, Agent, or Firm*—Price, Heneveld, Cooper, DeWitt & Litton

[57] ABSTRACT

The specification discloses an impeller for cleaning devices. A plurality of impeller segments are slipped over a twisted flat wire to provide the impeller. Each of the impeller segments preferably includes a plurality of paddles, and a central section with a non-cylindrical opening for receiving said twisted flat wire.

26 Claims, 1 Drawing Sheet

DEBRIS IMPELLER

BACKGROUND OF THE INVENTION

The present invention relates to debris impellers for vacuum cleaners, floor sweepers, surface cleaning extractors, or the like.

Floor cleaners are known which use a rotating brush with bristles thereon for lifting debris off a floor, or out of a carpet or rug. These rotating brushes also throw the debris into a dirt pan or bag. A problem with such brushes is hair, fur, lint and other debris tends to get caught in the bristles which prevents effective lifting and throwing of debris into the debris receptacle used therewith Combs have been used to remove debris caught in the bristles of such brushes. Although such combs remove the debris stuck in the bristles as the brush is rotated, these combs increase the amount of force required to turn the brushes, and thus increase the force required to move the cleaning device Use of a comb and brush is particularly a problem on slippery floors where the wheels which drive the brush will slide on the floor as the force required to turn the brushes through the comb is greater than the friction between the drive wheels and the floor.

An alternative to the bristle brush is an impeller constructed from elongated blades which are received in slots within a metal core. One such impeller is shown in U.S. Pat. No. 4,845,797 issued to Kobayashi which includes an extruded metal core having slots formed therein to receive blades. Another is shown in U.S. Pat. No. 1,267,304 issued to Adams which includes a core having slots for receiving blades having holes therein. United Kingdom Patent 642,819 shows another impeller which is an assembly of metal brackets which form channels for receiving blades therebetween. The elongated blades of these impellers may include dimples, lateral ribs, or holes for lifting debris. These blades, like the brushes described above, collect debris which must be removed in order for the blade to continue to effectively pick up debris. In order to remove such debris, a surface must be positioned to contact the blades as they rotate, which increases the force required to rotate the impeller, and thus has the disadvantage of increasing the force required to push the machine and turn the impeller drive wheels. Additionally, these impellers are relatively difficult to manufacture and consequently are relatively costly. Another disadvantage of some of these impellers is the blades are made from a material which mars the floor as the impeller rotates, or interact with the plasticizer in some floors, such as vinyl flooring when the impeller is at rest, which causes the blade material or coloring to transfer to the floor, or react with chemicals used to clean floors in residential or commercial settings.

SUMMARY OF THE INVENTION

The present invention comprises an impeller formed by a plurality of individual integrally molded impeller segments, each of which includes a central body and a plurality of paddles. Significant manufacturing advantages are realized by having a plurality of substantially identical molded impeller segments each of which has a non-cylindrical opening adapted to receive a twisted flat wire axle whereby said impeller may be assembled by slipping said segments over the axle. These and other objects, advantages and features will become apparent upon review of the following specification in conjunction with the drawings.

DESCRIPTION OF THE PREFERRED EMBODIMENT

Figure 1:
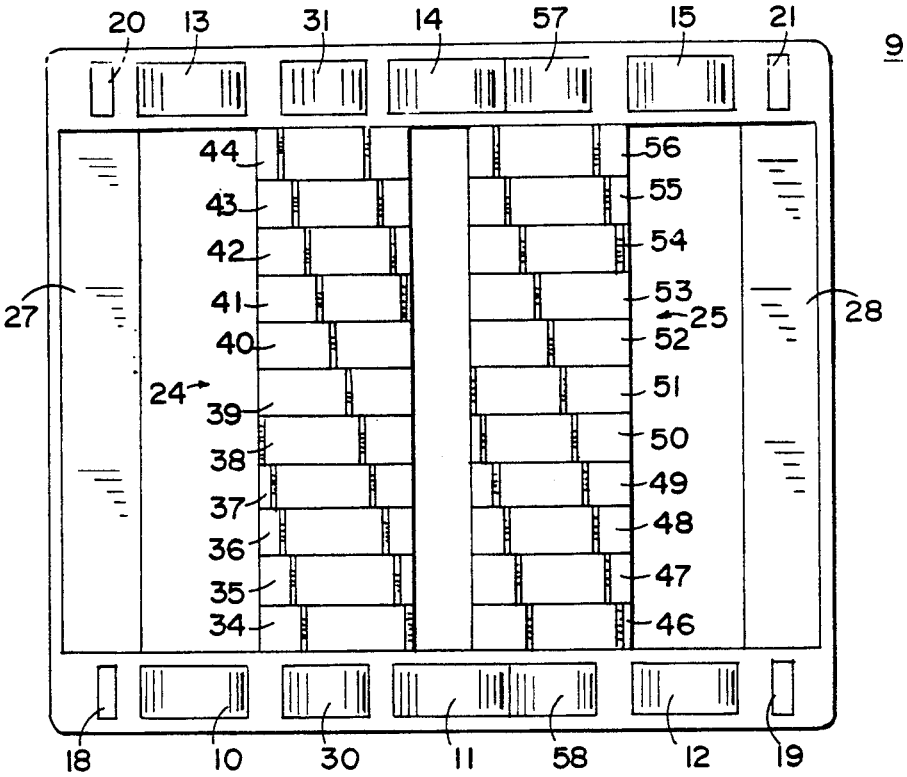
FIG. 1 is a bottom perspective of a mechanical sweeper including impellers according to the invention.
Figure 6:
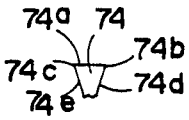
FIG. 6 is a fragmentary side view of the remote end of a paddle designated by VI in FIG. 3.
Figure 3:
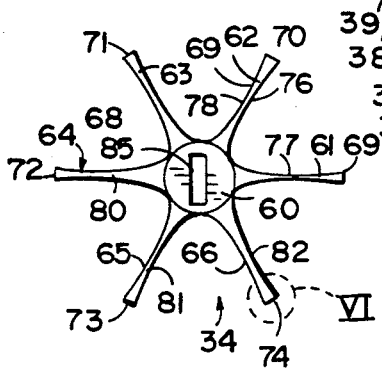
FIG. 3 is a side elevation of an impeller segment of the invention.
Figure 2:
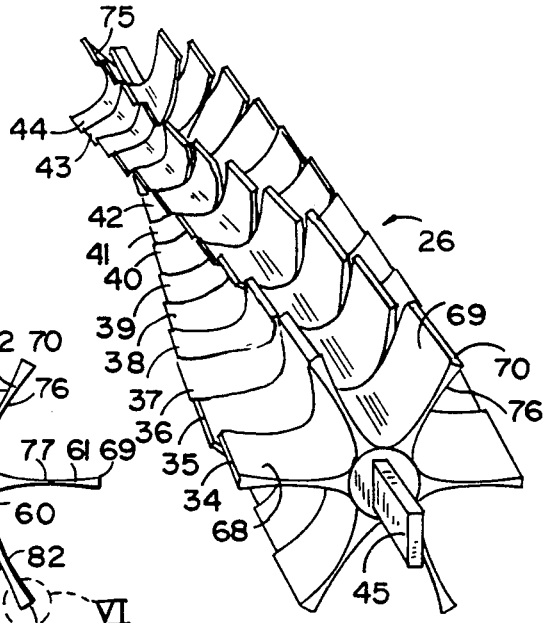
FIG. 2 is a perspective view of an impeller assembly.

Referring initially to FIG. 1, impellers 24 and 25, according to the invention, are illustrated in a mechanical sweeper 9. Mechanical sweeper 9 includes six wheels A front wheel 10, a middle wheel 11, and a back wheel 12 are provided on one side, and a front wheel 13, a middle Wheel 14 and a back wheel 15 are provided on the other side. Additionally, brushes 18, 19, 20 and 21 are provided to move debris which is located in the path of the wheels and outside the cleaning area of the impellers. Front impeller 24 and back impeller 25 are provided to pick up debris and throw it into a front dirt bin 27 and a back dirt bin 28, respectively. Impeller 24 is driven by a drive wheels 30 and 31, which in turn are driven by a middle wheels 11 and 14 when the sweeper is moving backward. Impeller 24 is illustrated with eleven impeller segments 34–44, although more or less than eleven segments may be provided. Impeller 25 includes eleven impeller segments 46–56. Impeller 25 is driven by drive wheels 57 and 58 which, in turn, are driven by middle wheels 11 and 14 when the mechanical sweeper is moving forward A perspective of impeller 24 is illustrated in FIG. 2. Impellers 24 and 25 are substantially identical and thus only impeller 24 will be described in detail below. Impeller 24 includes eleven identical impeller segments 34–44 which are slipped over a twisted flat wire 45. Each segment includes a central hub 60 (FIG. 3), as well as six identical elastic paddles 61–66. The paddles have respective ends 69–74 which are thicker than respective mid-sections 77–82. The thicker ends have sufficient mass to provide momentum for throwing debris into debris bin 27 or for pushing liquids. Thin mid-sections 77–82 provide substantial flexibility and spring which allows ends 69–74 to throw debris deep into debris bin 27. Additionally, impeller segments 34–44 include a central opening 85 in central body 60 for receiving the twisted flat wire 45 and keyed to insure rotation of the segments with rotation of the flat wire. The front and back surfaces of each of the paddles, such as 69 and 76 of paddle 70 (FIG. 2), are substantially rectangular and arced inwardly, and thus as seen from the side of the paddles (FIG. 3), have a generally elliptical curve. As shown in FIG. 6, a tip **74*a* is flat and rectangularly shaped as seen from a direction orthogonal thereto. Tip 74*a* thus forms a first linear projecting, edge 74*b* where curved surface 74*d* meets flat tip 74*a* and a second linear projecting edge 74*c* where curved surface 74*d* meets the flat tip 74*a***. The paddles thus form a generally pointed end joined with a curved surface which digs into carpets and rugs, and scoop debris and liquids off of a hard floor.

Figure 4:
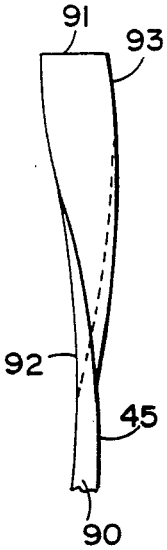
FIG. 4 is a plan view of a twisted axle of the invention.
Figure 5:
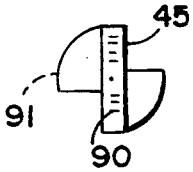
FIG. 5 is an end view of an axle of the invention.

As illustrated in FIGS. 4 and 5, twisted flat wire 45 includes ends 90 and 91 which are oriented at an angle of approximately 90° with respect to each other. Ends 90 and 91 are connected by a substantially continuous helical curve therebetween. However, end portions 92 and 93 of twisted wire 45 near ends 90 and 91 may be substantially straight for receiving drive wheels 30 and 31 (FIG. 1) of impeller 24. The flat wire is twisted such that the paddles of the impeller segments will not be oriented linearly with respect to each other. The twist is such that when mounted on axle 45, impeller 34 and impeller 44 are rotationally positioned with respect to each other by greater than, or equal to, 360° divided by the number of paddles on each impeller segment and less than two times 360 divided by the number of paddles on each impeller segment. Thus, where six paddles are provided on each segment, the twist in wire 45 will position paddles 70 (FIG. 2) and 75 with an angle which is greater than 59° and less than 120° therebetween In operation, as mechanical sweeper 9 (FIG. 1) is moved over a surface in a forward direction, middle wheels 14 and 11 will be pressed against drive wheels 57 and 58 of rear impeller 25 which will drive impeller 25 to throw debris into bin 28. When the sweeper is moved in the opposite direction, drive wheels 11 and 14 will swing into contact with wheels 30 and 31 of impeller 24, causing impeller 24 to rotate and throw debris into bin 27. When impeller 25 is being driven by wheels 11 and 14, the floor will cause impeller 24 to rotate upon motion of the sweeper, whereas impeller 25 will be driven by the motion of the middle wheels. Similarly, when impeller 24 is driven by middle wheels 11 and 14, the floor causes impeller 25 to roll with the motion of the sweeper, whereas impeller 24 is driven by middle wheels 11 and 14. The paddles of segments 34–44 of impeller 24, and segments 46–56 of impeller 25, will sequentially come into contact with the floor as the respective impellers are rotated. The narrow portion 77–82 (FIG. 3) of the impeller paddles will be the point of flex and as the impeller paddles come off the floor ends 69–74 will spring back to the at rest position and thus throw the dirt into the dirt bins.

Impeller 24 is assembled in a relatively simple manner. A flat wire 45 of appropriate length is twisted to provide an axle for receiving impeller segments 34–44. Each of the impeller segments 34–44 are identical and thus the same mold is used to make all the segments. To assemble the impeller, segments 34–44 are slid over the twisted flat wire 45 and the angle of the segments with respect to each other is provided by the twist in the flat wire itself. The drive wheels 30 and 31 are then slid onto the ends of the twisted flat wires. Drive wheel 30 is preferably molded plastic, and includes a channel which receives an axle carried by the chassis of the mechanical sweeper. Drive wheel 31 is preferably molded plastic and has an axle which is received by a channel carried by the chassis of the mechanical sweeper. The impellers are most preferably made from a material which is non-marring, is non-migrating, and will not react with chemicals used for cleaning floors in commercial and residential settings. One material which may be advantageously used is Santaprene 201-55, which is a fully vulcanized polyolefinic material which has a hardness of 55 on the Share A scale, is colorable, and most preferably has a color concentrate added thereto Thus, the impeller segments will not damage the surface which is being cleaned when paddles move across or rest thereon Axle 45 may be brushed aluminum or painted steel flat-wire.

Impeller 25 is assembled in the same manner as impeller 24. Segments 46–56 are slid over a twisted flat wire axle. Drive wheels 57 and 58 are then slid onto the ends of the twisted flat wire axle. Drive wheel 57 includes a channel which receives an axle carried by the chassis of the sweeper, and drive wheel 58 has an axle which is received in a channel carried by the chassis of the mechanical sweeper.

Thus, it can be seen that an impeller is disclosed which is easy to manufacture, and thus can be provided at a relatively low cost. Additionally, the impeller includes impeller segments which have paddles providing a significant amount of lift and throwing force which will propel debris into the debris receptacle used therewith.

The above description is considered that of the preferred embodiment only. Modifications of the invention will occur to those who make or use the invention. Therefore, it is understood that the embodiments shown in the drawings and described above are merely for illustrative purposes and are not intended to limit the scope of the invention which is defined by the following claims as interpreted according to the principles of patent law.

The embodiments of the invention in which an exclusive property or privilege is claimed are defined as follows.

1. An impeller for floor cleaning devices, including:
an axle having a non-cylindrical cross section;
a plurality of individual integrally molded impeller segments each having a plurality of paddles and a central body with a non-cylindrical central opening adapted to be slipped over said axle, whereby said impeller may be assembled by said plurality of segments being slipped over said axle.

2. The impeller as defined in claim 1, wherein said axle is twisted to provide a non-linear orientation of tips of adjacent paddles when said plurality of segments are received on said axle.

3. The impeller as defined in claim 2, wherein said bar is twisted such that one end of said axle is oriented at an angle of approximately 90° with respect to the other end of said axle and said twist forms a continuous curve substantially from said one end to said other end.

4. The impeller as defined in claim 2, wherein each of said paddles of each of said segments has a respective end which is thicker than the respective mid-section of each of said paddles.

5. The impeller as defined in claim 4, wherein said twist of said axle is such that an impeller on said one end of said axle is rotated with respect to an impeller at said other end by an angle which is greater than or equal to 360° divided by the number of paddles on each segment and less than 360° divided by one-half the number of paddles on each segment.

6. The impeller as defined in claim 5, wherein said segment is made of a non-marring, non-transferring, material which will not interact with floor cleaning chemicals used in commercial and residential settings.

7. An integrally molded impeller segment for cleaning devices, comprising:
a plurality of elastic tapered paddles, each paddle having a thicker end than mid-section whereby said mid-section provides flex and spring and said end provides mass for throwing debris or pushing liquids; and a central body from which said paddles project, said body having a non-cylindrical central opening adapted to be slipped over an axle.

8. An impeller segment as defined in claim 7, wherein each said paddle has a front surface and a back surface which are substantially elliptically curved, and a tip which is substantially flat and rectangular, whereby said concave surfaces and said flat end form a corner for removing dirt from a carpet or rug and for lifting debris and liquids off of hard surfaces as they rotate.

9. An impeller including a plurality of impeller segments as defined in claim 8, wherein said impeller includes a plurality of said impeller segments carried by a non-cylindrical axle.

10. The impeller as defined in claim 9, wherein said non-cylindrical axle is twisted to provide a non-linear orientation of adjacent ends of said paddles.

11. The impeller as defined in claim 10, wherein said non-cylindrical axle is twisted such that one end of said axle is oriented at an angle of approximately 90° with respect to the other end of said axle and said twist is continuous from substantially said one end to substantially said other end.

12. The impeller as defined in claim 10, wherein said segments are substantially identical and said ,twist of said axle is such that an impeller at said one end is positioned with respect to a segment at said other end at an angle which is greater than or equal to 360° divided by the number of paddles on each segment and less than 360° divided by one-half the number of paddles on each segment.

13. The impeller as defined in claim 12, wherein said paddles is made of a non-marring and non-transferring material.

14. An integrally molded impeller segment of an impeller for cleaning devices which comprises a plurality of said segments, comprising:

at least one tapered paddle having a thicker end than mid-section, said at least one paddle having substantially uniform width throughout its length, and said at least one paddle having a front or back surface which is curved, and said at least one paddle having a substantially flat end.

15. The impeller segment as defined in claim 14, wherein each said impeller segment includes a central body with a non-cylindrical central opening adapted to be slipped over a similarly shaped non-cylindrical axle.

16. An impeller comprising a plurality of impeller segments as defined in claim 15, wherein a plurality of said impeller segments are carried by said non-cylindrical axle.

17. The impeller as defined in claim 16, wherein said non-cylindrical axle is twisted to provide a non-linear orientation of ends of said paddles.

18. The impeller as defined in claim 17, wherein said non-cylindrical axle is twisted end of said axle is oriented at an angle of approximately 90° with respect to the other end of said axle and said twist is continuous from substantially said one end to substantially said other end.

19. An impeller segment as defined in claim 14 wherein said front and back surfaces are curved as viewed from a side of said at least one paddle.

20. A floor sweeper including a dust and debris receiving pan, an impeller which, upon rotation, lifts dust and debris into said pan, and drive means for rotating said impeller responsive to movement of said sweeper across a floor, said impeller comprising:

a plurality of integrally molded impeller segments, each including a central body, a plurality of paddles extending from said central body, said central body including a non-cylindrical central opening receiving an axle, said axle having a non-cylindrical cross section matching said non-cylindrical central opening, said axle being twisted to provide a non-linear orientation of tips of adjacent paddles when said plurality of impeller segments are received on said axle, and wherein each said impeller segment is molded from a non-marring, non-transferring, material which will not react with chemicals used for cleaning floors in residential and commercial settings.

21. An integrally molded impeller segment for cleaning devices used for lifting debris from a floor, comprising:

a central body, a plurality of paddles extending from said central body, said central body including a central opening, and wherein said impeller segment is molded from a non-marring, non-transferring, material which will not react with chemicals used for cleaning floors in residential and commercial settings, wherein said paddles are elastic tapered paddles, each paddle having a thicker end than mid-section, whereby said mid-section provides flex and spring and said end provides mass for throwing debris or pushing liquids.

22. An impeller segment as defined in claim 21, wherein each said paddle has a front surface and a back surface which are substantially elliptically curved, and a tip which is substantially flat and rectangular, whereby said concave surfaces and said flat end form an edge for removing dirt from carpets and rugs and for lifting debris and liquids off of hard surfaces as they rotate.

23. A method of providing a debris impeller for cleaning devices used for lifting debris from a floor, comprising the steps of:

providing a twisted axle which has non-cylindrical cross section; and providing a plurality of substantially identical impeller segments comprising a plurality of paddles projecting from a central body wherein said central body includes a central opening adapted to receive said axle whereby said segments may be slid over said axle to form said impeller.

24. The method of providing an impeller as defined in claim 22, wherein said step of providing a plurality of segments includes providing segments comprising elastic tapered paddles, each paddle having a thicker end than mid-section whereby said mid-section provides flex and spring and said end provides mass for throwing debris and pushing liquids.

25. The method as defined in claim 24, wherein said step of providing a plurality of paddles further includes providing paddles each of which has a front surface and a back surface which are substantially rectangular and arced inwardly, and a tip which is substantially flat and rectangular, whereby said concave surfaces and said flat end form an edge for removing debris from carpets and rugs and for lifting debris and liquids off of hard surfaces as they rotate.

26. A floor sweeper including a dust and debris receiving pan, an impeller which, upon rotation, lifts dust and debris into said pan, and drive means for rotating said impeller responsive to movement of said sweeper across a floor, said impeller comprising:

a plurality of integrally molded impeller segments, each including a central body, a plurality of paddles extending from said central body, said central body including a central opening receiving an axle, and each said impeller segment being molded from a non-marring, non-transferring, material which will not react with chemicals used for cleaning floors in residential and commercial settings; and each said central body having an outer diameter, said paddles having a length substantially greater than said outer diameter of said central body.

* * * * *

UNITED STATES PATENT AND TRADEMARK OFFICE

CERTIFICATE OF CORRECTION

PATENT NO. : 5,148,569

DATED : September 22, 1992

INVENTOR(S) : John J. Jailor et al.

It is certified that error appears in the above-identified patent and that said Letters Patent is hereby corrected as shown below:

Column 1, line 15:
After "therewith" insert --.--.

Column 1, line 20:
After "device" insert --.--.

Column 2, line 21:
After "wheels" insert --.--.

Column 2, line 23:
"Wheel 14" should be --wheel 14--.

Column 2, line 38:
After "forward" insert --.--.

Column 3, line 15:
"360" should be --360°--.

Column 3, line 19:
After "therebetween" insert --.--.

Column 3, line 66:
After "thereto" insert --.--.

Column 4, line 1:
After "thereon" insert --.--.

Column 5, line 25:
",twist" should be --twist--.

UNITED STATES PATENT AND TRADEMARK OFFICE

CERTIFICATE OF CORRECTION

PATENT NO. : 5,148,569

DATED : September 22, 1992

INVENTOR(S) : John J. Jailor et al.

It is certified that error appears in the above-identified patent and that said Letters Patent is hereby corrected as shown below:

Column 5, line 56:
After "twisted" insert --such that one--.

Column 6, line 48, claim 24:
"claim 22" should be --claim 23--.

Signed and Sealed this

Twenty-eighth Day of December, 1993

*Attest:*

Bruce Lehman

BRUCE LEHMAN

*Attesting Officer*

*Commissioner of Patents and Trademarks*